US005583393A

United States Patent [19]

Jones

[11] Patent Number: 5,583,393

[45] Date of Patent: Dec. 10, 1996

[54] SELECTIVELY SHAPED FIELD EMISSION ELECTRON BEAM SOURCE, AND PHOSPHOR ARRAY FOR USE THEREWITH

[75] Inventor: Gary W. Jones, Raleigh, N.C.

[73] Assignee: FED Corporation, Hopewell Junction, N.Y.

[21] Appl. No.: 217,416

[22] Filed: Mar. 24, 1994

[51] Int. Cl.[6] ..... H01J 1/30; H01J 29/18; H01J 63/04

[52] U.S. Cl. ..... 313/495; 313/309; 313/310; 313/336; 313/351; 313/496; 313/466; 445/50

[58] Field of Search ..... 313/309, 310, 313/336, 351, 495, 496, 230, 461, 466, 473, 476, 359.1; 445/50

[56] References Cited

U.S. PATENT DOCUMENTS

| | | | |
|---|---|---|---|
| 3,497,929 | 3/1970 | Shoulders et al. | 445/50 |
| 3,665,241 | 5/1972 | Spindt et al. | 313/351 |
| 3,753,022 | 8/1973 | Fraser, Jr. | 313/78 |
| 3,921,022 | 11/1975 | Levine | 313/309 |
| 3,935,500 | 1/1976 | Dess et al. | 313/495 |
| 3,970,887 | 7/1976 | Smith et al. | 313/309 |
| 3,982,147 | 9/1976 | Redman | 313/309 |
| 3,998,678 | 12/1976 | Fukase et al. | 156/3 |
| 4,008,412 | 2/1977 | Yuito et al. | 313/309 |
| 4,095,133 | 6/1978 | Hoeberechts | 313/336 |
| 4,256,532 | 3/1981 | Magdo et al. | 156/628 |
| 4,277,883 | 7/1981 | Kaplan | 29/571 |
| 4,307,507 | 12/1981 | Gray et al. | 29/580 |
| 4,337,115 | 6/1982 | Keda et al. | 156/659.1 |
| 4,498,952 | 2/1985 | Christensen | 156/643 |
| 4,513,308 | 4/1985 | Greene et al. | 357/55 |
| 4,578,614 | 3/1986 | Gray et al. | 313/309 |
| 4,614,564 | 9/1986 | Sheldon et al. | 156/657 |
| 4,670,090 | 6/1987 | Sheng et al. | 156/653 |
| 4,683,024 | 7/1987 | Miller et al. . | |
| 4,685,996 | 8/1987 | Busta et al. | 156/628 |
| 4,724,328 | 2/1988 | Lischke | 250/492.2 |
| 4,774,433 | 9/1988 | Ikebe et al. | 313/362.1 |
| 4,824,795 | 4/1989 | Blanchard | 437/62 |
| 4,853,545 | 8/1989 | Rose | 250/396 R |
| 4,926,056 | 5/1990 | Spindt | 313/230 |
| 4,964,946 | 10/1990 | Gray et al. | 156/643 |
| 4,990,766 | 2/1991 | Simms et al. | 250/213 |
| 5,019,003 | 5/1991 | Chason | 313/309 |
| 5,030,895 | 7/1991 | Gray | 315/350 |
| 5,053,673 | 10/1991 | Tomii et al. | 313/308 |

FOREIGN PATENT DOCUMENTS

| | | |
|---|---|---|
| 5894741 | 6/1993 | Japan . |

OTHER PUBLICATIONS

Warren, J. B., "Control of Silicon Field Emitter Shape with Isotropically Etched Oxide Masks" Inst. Phys. Ser. No. 99, Section 2, pp. 37–40, 1987.

*Primary Examiner*—Nimeshkumar Patel
*Attorney, Agent, or Firm*—Robert G. Rosenthal; Intellectual Property/Technology Law

[57] ABSTRACT

A field emitter device for selective emission of an electron and/or ion beam comprising a substrate member having an array of field emitter elements thereon, in which the field emitter elements and/or substrate member have a varied conformation producing a beam of appropriate focused and/or directional character. Also disclosed is a display article for producing an output in response to impingement of electron beams thereon, comprising a substrate member on which is disposed an array of phosphor elements, with a diamond-like film coated on the phosphor elements to maintain the phosphor elements in position on the substrate member. Also disclosed is a field emission apparatus comprising such field emitter device and display article, such as a flat panel display.

19 Claims, 9 Drawing Sheets

SELECTIVELY SHAPED FIELD EMISSION ELECTRON BEAM SOURCE, AND PHOSPHOR ARRAY FOR USE THEREWITH

BACKGROUND OF THE INVENTION

1. Field of the Invention

This invention relates to a novel means for shaping and focusing electron beams using field emitter devices, and to a novel phosphor array of a type which may be usefully employed with such field emitter electron beam device.

2. Description of the Related Art

Electron beam source means are utilized in a wide variety of microelectronic and optoelectronic applciations. Examples include flat-panel displays, CRTs, klystrons, cross field amplifiers, triodes, pentodes, electron beam microscopes, and E-beam writing tools.

Although it would be highly advantageous to use an electron beam source in such applications which is readily adapted to provide a specific desired electron beam focusing character and a selectively shaped electron beam which is optimal for the given end application, the electron beam source means of the prior art are generally limited to innate focusing effects.

It therefore is one object of the present invention, in one aspect thereof, to provide a field emitter source means which overcomes such intrinsic limitation, and which may be used to produce an almost infinite range of electron beam focusing and electron beam shaping capabilities.

In the use of field emitter source means for display applications, wherein the electron beam is directed to a screen or plate member having phosphor elements thereon, various problems predominate at high brightness and power levels. These include the problems of phosphor particle migration, and the problem of dissipating the significant amounts of heat which are generated in such high energy regimes.

It therefore is another object of the present invention, in another aspect thereof, to provide a phosphor array in which the phosphor elements are constructed and arranged to substantially reduce such migration and thermal dissipation deficiencies of the prior art.

Other objects and advantages of the invention will be more fully apparent from the ensuing disclosure and appended claims.

SUMMARY OF THE INVENTION

In one general aspect of the present invention, an array of field emitter elements, e.g., an array of ungated column emitters, is utilized in which the emitters are arranged to create shaped electron beams with built-in focusing.

The invention therefore contemplates field emitter array (FEA) structures which provide an electron beam focusing array which is simple and economical in construction, and highly efficient in use. The array is suitably formed as hereinafter more fully described, to permit selective contouring of electric field lines and electron emission characteristics, to yield electron beam conformations which are selectively highly focused and shaped to the desired beam geometry.

A further specific aspect of the invention relates to ion source devices, comprising an array of field emitter elements which provide ion beam focusing and shaping.

The electron/ion beam focusing and shaping which are effected in the practice of the invention may be provided by widely varying conformations (spatial arrangements, compositional or materials arrangements, or other physical or materials properties variations in the field emitter array) of the field emitter elements and/or substrate members on which the field emitter elements are disposed, as hereinafter more fully described.

In the general practice of the invention, an array of field emitter elements is employed in which the field emitter elements preferably are subjected to the same input voltage, so that the variations in electron/ion beam intensity and/or directional flux are attributable solely to the variance of field emitter and/or substrate conformation. It will be recognized, however, that the input voltage may be selectively varied for different emitter elements or sub-arrays of such elements, in addition to such variance of field emitter and/or substrate conformation in accordance with the present invention, to provide additional focusing and/or shaping of the electron/ion beam, as necessary or desired in a given end use application of the structures and methods of the present invention.

In another aspect of the invention, a display unit is provided, of suitable character for use with the above-described electron beam source means. This display unit comprises a substrate member on which is disposed an array of phosphor elements, with a high thermal conductivity diamond-like film coated on the phosphor elements to (1) maintain the phosphor elements in position, (2) provide enhanced thermal conductivity for facilitating heat dissipation in operation of the display unit, when the phosphor elements are impinged with electron beams, and (3) provide sufficient electrical conductivity to transfer charge away from the illuminated area of the display unit.

As used herein, the term "diamond-like film" refers to a film of carbonaceous composition which (i) is of suitable thickness, e.g., on the order of 20 nanometers to 200 nanometers, for penetration by electron beams, and (ii) has a diamond crystalline structure or crystallite moieties therein.

In a related method aspect of the invention, a phosphor-element display unit is formed by disposing phosphor elements in an array on a substrate member, and depositing the diamond-like film, or a precursor thereof, on the phosphor elements to achieve the aforementioned advantages (1)–(3) set out above.

In a variation of this methodology, the phosphor elements on the substrate may be overcoated with a sacrificial material layer, e.g., a layer of nitrocellulose or other material which is readily removable by physical or chemical treatment methods (e.g., heating in the case of the nitrocellulose sacrificial layer). The sacrificial layer then has the diamond-like film deposited thereon, followed by removal of the sacrificial layer. The sacrificial layer thus effects a substrate smoothing action.

In another modification of this methodology, the diamond-like film may be doped with a suitable dopant species, e.g., boron or nitrogen, to produce film darkening and provide enhanced contrast character to the resulting display unit.

The invention encompasses the display units produced by the above method variations and modifications.

The invention in a further aspect relates to a field emitter device includes an evacuated enclosure with an electron beam source means and an anode structure comprising a substrate member having the diamond-like film deposited on the phosphor elements, wherein the diamond-like film possesses a gettering character, being sorptively effective for the removal of contaminant (off-gas, interiorly diffusing environmental gases) gas species from the evacuated enclosure.

Other aspects and features of the present invention will be more fully apparent from the ensuing disclosure and appended claims.

DETAILED DESCRIPTION OF THE INVENTION, AND PREFERRED EMBODIMENTS THEREOF

The present invention is based on the discovery that an electron or ion beam may be selectively intensified (focused) and directed by suitable conformational arrangement of field emitter elements and/or substrate members in an array of such elements.

As discussed hereinabove, the electron/ion beam focusing and shaping carried out in the practice of the invention may be achieved by varying conformations (spatial arrangements, compositional or materials arrangements, or other physical or materials properties variations in the field emitter array) of the field emitter elements and/or substrate members on which the field emitter elements are disposed. These various conformations which may be usefully employed in accordance with the invention include the illustrative embodiments hereinafter described.

More specifically, these various conformations include, but are not limited to:

(i) a varying density of emitter elements on the substrate member;

(ii) an electrical resistance-varying composition of the field emitter elements, which is variable among the field emitter elements of the array, or sub-array portions thereof;

(iii) an electrical resistance-varying composition of the substrate member or portions thereof;

(iv) an electrical resistance-varying material interposed between the substrate member and at least some of the field emitter elements of the array;

(v) varying height among the field emitter elements of the array;

(vi) varying shape among the field emitter elements of the array; and (vii) a non-planar shape of the substrate member over at least a portion of its surface area having the field emitter elements disposed thereon.

Figure 1:
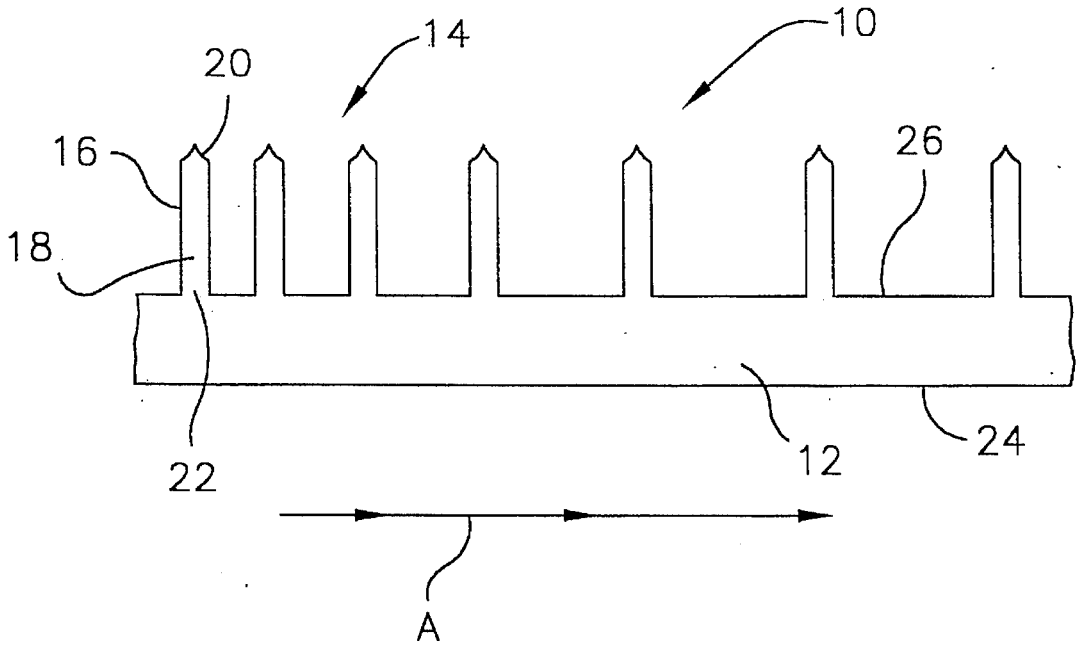
FIG. 1 is a schematic elevation view of an array of columnar field emitter elements, according to one embodiment of the present invention.

Referring now to the drawings, in respect of the various illustrative, non-limiting embodiments of various aspects and features within the scope of the present invention, FIG. 1 shows a schematic elevation view of a field emitter device 10 according to one embodiment of the invention.

The field emitter device 10 comprises a substrate member 12, formed of a suitable material such as silicon or other conductive material of construction, on which is disposed an array 14 of field emitter elements 16. The field emitter elements 16 are as illustrated of columnar shape, having a main cylindrical body portion 18 at the upper extremity of which is a convergent tip 20 which may be of sharpened character, as produced by super sharpening techniques conventionally known and used in the art. Each of the field emitter elements 16 is integrally joined at its lower extremity 22 to the substrate member 12, with the field emitter elements being suitably integrally formed by conventional fabrication techniques including etching of the substrate to provide such columnar elements.

On the back side 24 of the substrate member 12, the backside being the side surface opposite the surface 26 on which the field emitter elements 16 are disposed, there may be provided a backside metal coating of suitable metal, such as titanium. Illustrate beneath the field emitter device 10 is an arrow A indicating the direction of decreasing field emitter element density. In other words, in viewing the field emitter device from left to right, the number of field emitter element 16 per unit area decreases, as is reflected by the increased column spacing in such direction A.

It will be recognized that the field emitter device 10 shown in FIG. 1 has been generally schematically shown for ease of illustration. In actual fabrication, the field emitter elements 16 may be of a two-dimensional array character, as shown in the drawing, or, more preferably, such array of field emitter elements may be three dimensional in character, with field emitter elements being provided across the full areal extent of the surface 26, across the length (in the direction A) and width directions of such top surface 26.

In the FIG. 1 device, along the direction A, the field emitter element density decreases, as mentioned above. In such direction A, the electric field at the tip of the field emitter element increases, with decreasing turn-on voltage being required. In preferred practice, the input voltage to each field emitter element 16 in the array 14 is equal, and the threshold turn-on voltage level for the emitter having the lowest turn-on voltage in the array. Such uniform input voltage may be provided to the field emitter elements via current-carrying grid work, conductive layers, or other means conventionally employed in the art to energize the field emitter elements in an array containing a multiplicity of such elements. Nonetheless, it is also within the broad purview of the present invention to provide a field emitter array which is constructed and arranged for focusing and/or selective directing of the electron beam or ion beam, with the field emitter device being concurrently constructed and arranged to provide unequal voltages to various individual emitter elements or groups of emitter elements in the array.

Thus, in the array shown in FIG. 1, the successive elements in the direction A have decreasing turn-on voltage levels, and the voltage may be selectively inputted to the respective emitter elements in relation to their threshold turn-on voltage characteristics.

In the FIG. 1 array, along the direction A, there is a decreasing space charge at high electric field conditions, as associated with the successive emitter elements shown.

The FIG. 1 array 14 thus illustrates the practice of the invention, wherein the field emitter element spacing may be varied to create a correspondingly varied electron beam associated with specific emitter elements.

In general, the size and shape of emitter elements in a field emission array may be widely varied to create various beam shape and/or extents of beam focusing. The density of emitter elements may be varied as shown in FIG. 1 to correct for extraction electric field non-uniformities, to modify intensity gradients within the electron/ion beam, to create built-in (intrinsic) electron trajectory control or ion trajectory control (depending on the electron source or ion source character of the field emitter device) for focusing.

Figure 2:
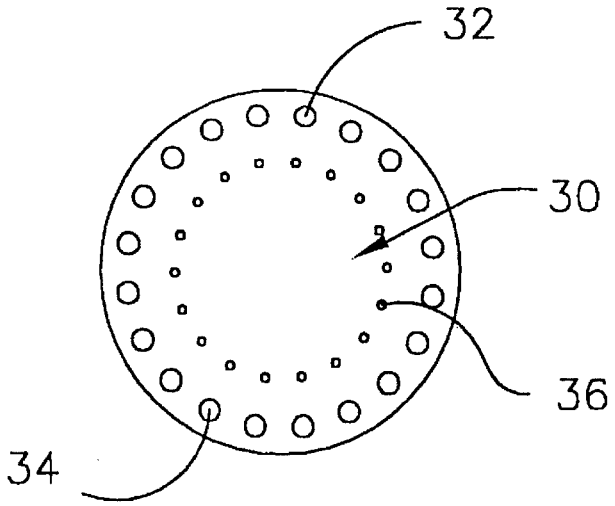
FIG. 2 is a top plan view of a columnar field emitter array of ring shape, according to another embodiment of the invention.

FIG. 2 is a top plan view of a columnar field emitter array 30 of ring shape, according to another embodiment of the invention. The array 30 comprises a plurality of columnar field emitter elements 32 which include an outer ring 34 of larger diameter, and an inner ring of field emitter elements 36 of smaller diameter. The columnar field emitter elements may be characterized geometrically by their height or length dimension (L) and their cylindrical cross-section diameter (D), as well as by the corresponding L/D aspect ratio, which typically is greater than 1 and may be of any suitable value, such as greater than 3. It will be recognized that such definition is specific to field emitter elements of circular cross-section (as measured perpendicular to the longitudinal axis emitter element), however it is within the purview of the present invention to utilize emitter elements of non-cylindrical shape, e.g., emitter elements having a quadrilateral of polygonal cross-section, or of any other geometrically regular or irregular cross-section shape, as necessary or desirable in the specific end use application involving the field emitter device of the present invention. It nonetheless is preferred in practice to utilize field emitter elements of columnar character comprising cross-sectional circular geometry, for ease fabrication and operational considerations.

Figure 3:
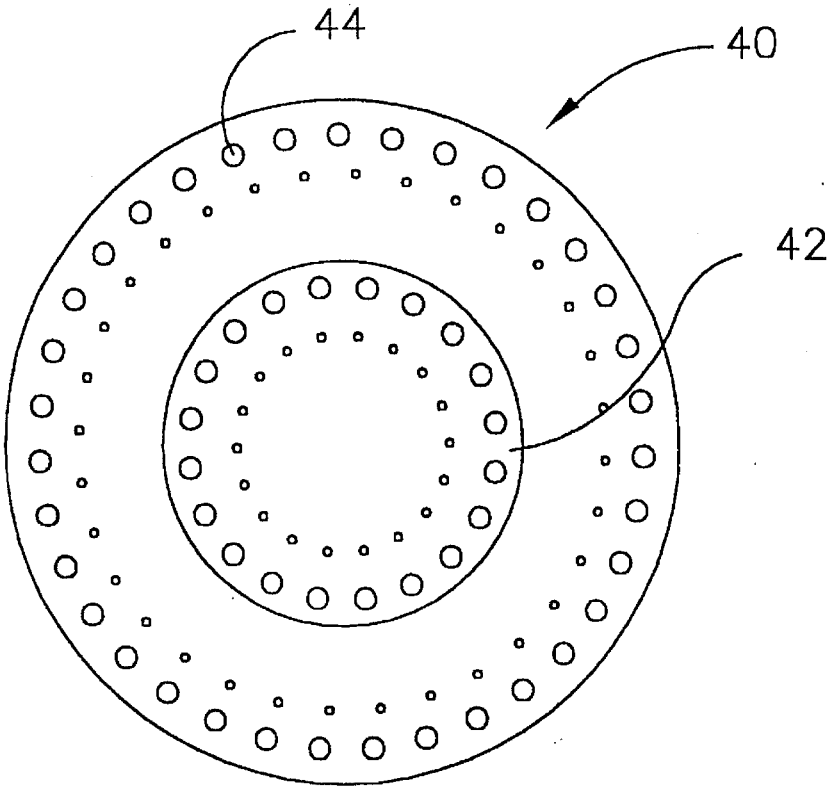
FIG. 3 is a top plan view of another columnar field emitter array of concentric ring shape, according to a further embodiment of the invention.

FIG. 3 is a top plan view of another columnar field emitter array 40 of ring shape, according to another embodiment of the invention. The array 40 comprises an inner ring portion 42 containing a multiplicity of columnar emitter elements of varied size, and an outer ring portion 44 comprising emitter elements of varying size, whereby the inner and outer ring portions 42 and 44, respectively, are concentric with one another.

Figure 4:
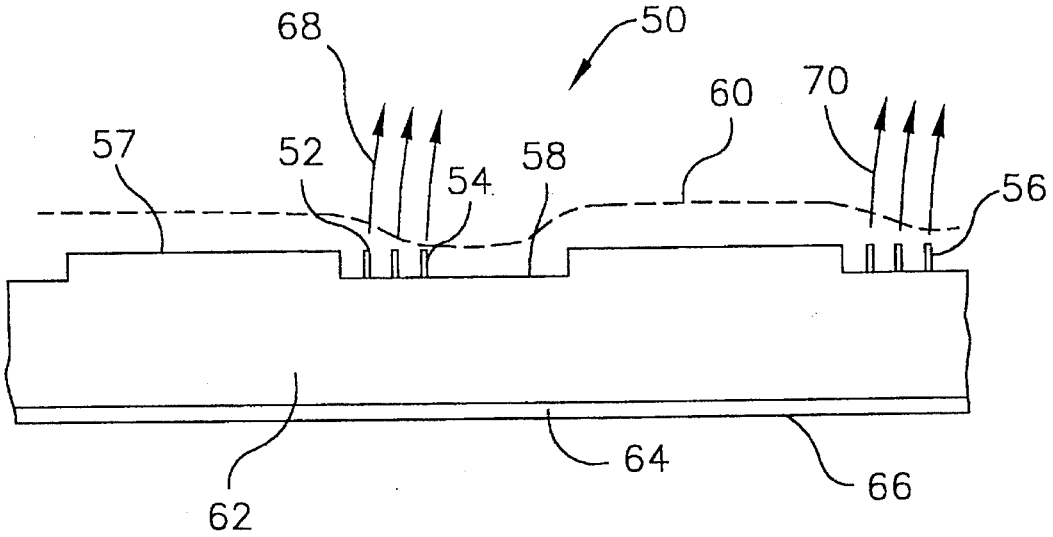
FIG. 4 is a side elevation sectional view of a portion of a field emitter device according to another aspect of the invention, utilizing the ring columnar field emitter arrays of FIGS. 2 and 3.

FIG. 4 is a side elevation of a portion of a field emitter device 50 according to another aspect of the invention utilizing field emitter elements 52 in spaced-apart arrays 54 and 56, as shown, wherein a higher ring structure 56 is provided with a lower ring structure 58, and with line 60 representing the equal potential line of the electric field associated with such emitter element arrays and ring structures.

The FIG. 4 field emitter device comprises a substrate member 62 which may be formed of any suitable material, such as for example silicon, and the substrate member may be provided on its back surface 64 with a backside contact layer 66 of suitable material (e.g., Ti+Al). The arrows 68 and 70 in FIG. 4 show the electron paths in the beam produced by emitter elements in array 54 and array 56, respectively.

The embodiments of FIGS. 2–4 thus show the utility of structures such as spaces or rings associated with the field emitter element arrays to create electron beam focusing effects, as shown by the electron beam fluxes in FIG. 4.

Figure 5:
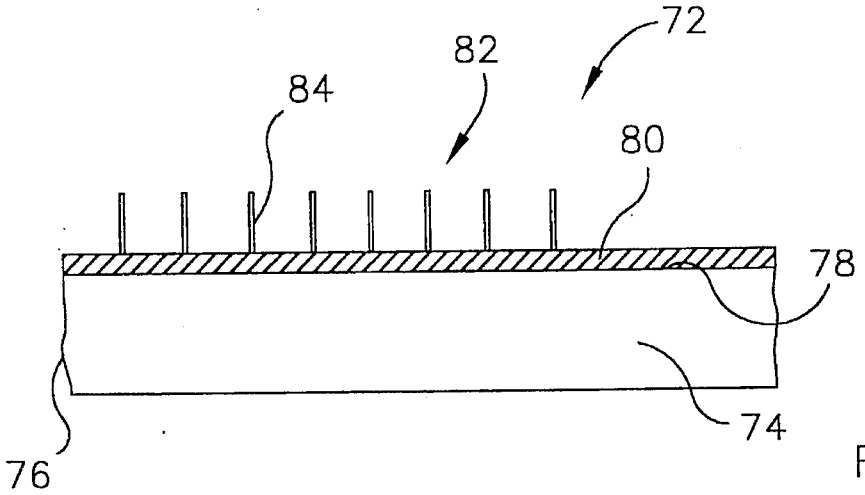
FIG. 5 is a side elevation view of a portion of a field emitter device utilizing a variable resistance substrate construction to create a self-focusing or beam-shaping effect.

FIG. 5 is a side elevation view of a portion of a field emitter device 72 utilizing a variable resistance substrate member 74 having a main body portion 76 of suitable material such as silicon, on the top surface 78 of which is coated a layer 80 of suitable material providing variable resistance character to the emitter device. The layer 80 may for example comprise an upper region of the substrate member main body portion which has been doped or implanted with a suitable dopant or impurity species conferring a varied resistance character to the substrate member, or alternatively the main body portion 76 may be overlaid with a separate and discrete deposited layer 80 as shown. An array 82 of field emitter elements 84 of columnar character is provided on the substrate member, and in the construction shown, the variable resistance layer 80 is interposed beween the main body portion 76 of the substrate member 74 and the field emitter elements 84 of array 82.

Figure 6:
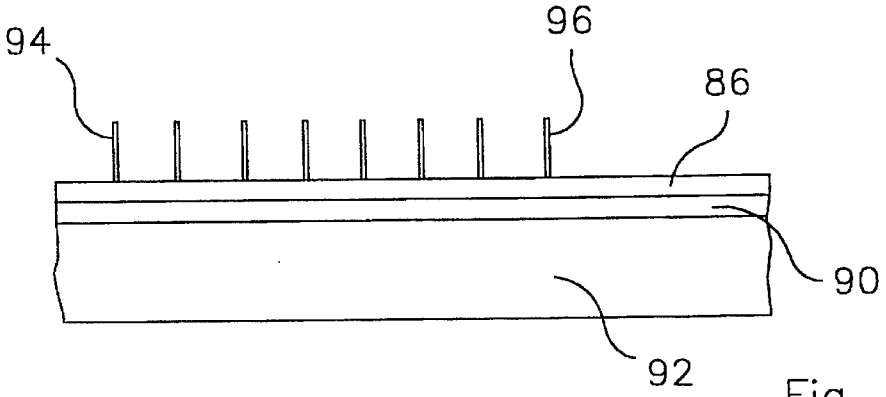
FIG. 6 is a side elevation view of a portion of a field emitter device utilizing a resistive layer on the substrate to create a self-focusing or beam-shaping effect.

FIG. 6 is a side elevation view of a portion of a field emitter device 96 utilizing a resistance layer 88 deposited on an intermediate conductive layer 90, in turn deposited on the substrate member 92. In this device, an array 94 of field emitter elements 96 is provided on the resistive layer, as shown. It will be recognized that the conductive layer 90 and resistive layer 88 may be deposited subsequent to formation of the field emitter elements 96 from a precursor of the substrate member 92, so that the field emitter elements 96 and substrate member 92 are integral to one another, with the layers 90 and 88 being subsequently deposited after formation of the emitter elements.

In the FIG. 6 device, the substrate member 92 may be of glass or other suitable material, and the conductor (conductive layer) 90 may be a suitable metal such as chromium. The resistive layer correspondingly may comprise a material such as chromium and silicon dioxide. In this FIG. 6 device, the resistivity characteristic of the resistive layer 88 may be selectively varied across the layer to produce constituent regions of varied resistivity, as usefully employed for focusing or redirecting the electron beams emitted by emitter elements 96 (redirection hereby referring to the direction of the device as constituted in FIG. 6, relative to a corresponding device lacking such variable resistance layer.

Figure 7:
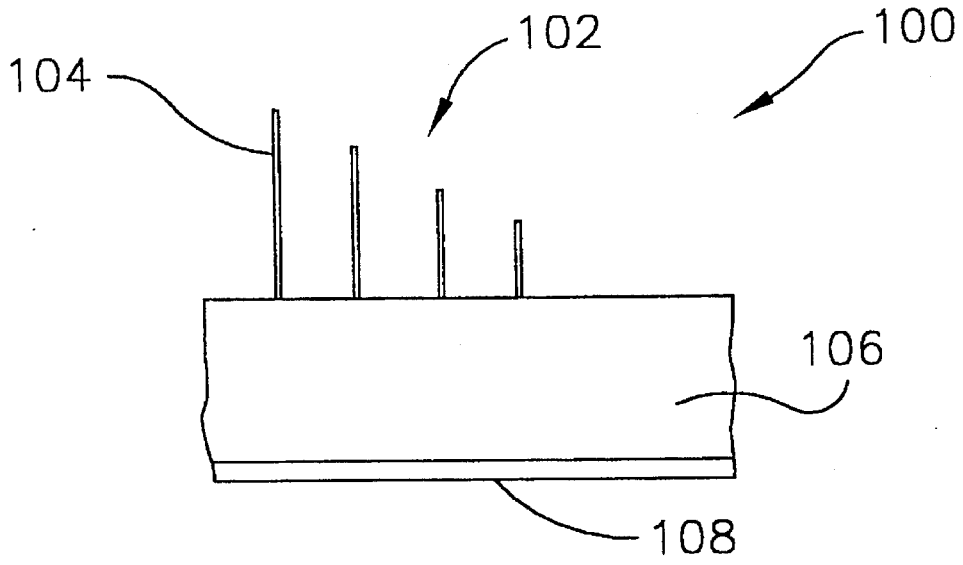
FIG. 7 is a side elevation view of a portion of a field emitter device utilizing a an array of columnar field emitter members of varying height, to create a self-focusing or beam-shaping effect.

FIG. 7 is a side elevation view of a portion of a field emitter device 100 comprising an array 102 of field emitter elements 104 of varying height, disposed on a substrate member 106 having a backside metal coating 108 thereon. Such varying height character of the emitter elements 104 and the array 102 is utilized to effect focusing of the resulting electron flux produced by the emitter when subjected to appropriate voltage operating conditions.

Figure 8:
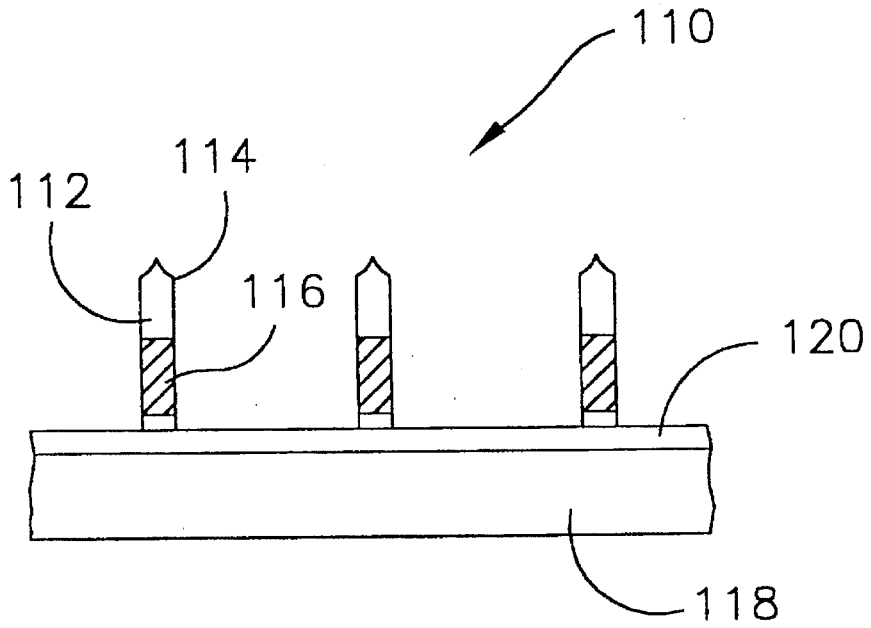
FIG. 8 is a side elevation view of a portion of a field emitter device utilizing a an array of columnar field emitter members of varying length tip/resistor components, to create a self-focusing or beam-shaping effect.

FIG. 8 is a side elevation view of a portion of a field emitter device 110 featuring an array of columnar field emitter elements 112 of varying length tip/resistor portions, to provide a self-focusing or beam-shaping effect. The emitter elements 112 as shown comprise an upper distal portion 114 which may for example be formed of silicon coated with a carbonaceous or diamond-like film or a processable conductor such as niobium, tantalum, titanium silicide, etc. The emitter elements 112 further comprise a proximal portion 116 which are of suitable composition providing a resistive character, e.g., of silica, composition. The emitter elements thus may have different length proximal resistor portions 116 serving to vary the resistance associated with the emitter element. The emitter elements may be disposed on the substrate member 118, which may for example be of glass, sapphire, or other suitable material, having formed thereon a base conductor 120, which may for example comprise chromium.

Figure 9:
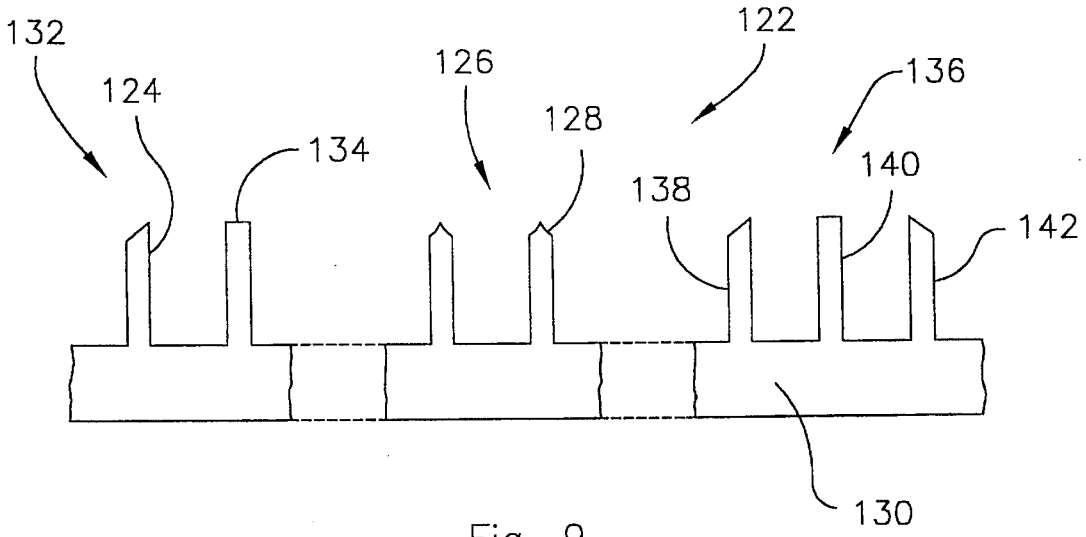
FIG. 9 is a side elevational view of a portion of a field emitter device featuring field emitter elements which are of varying tip shape, to correspondingly vary the shape and intensity of the electron beam which is produced by the device.

FIG. 9 is a side elevation view of a portion of a field emitter device 122 featuring field emitter elements 124 which are of varying tip shape, to correspondingly vary the shape and intensity of the electron beam(s) produced by the device.

Thus, the illustrative device 122 features a central array 126 of emitter elements of columnar configuration, having sharpened tips 128, wherein the emitter elements are formed integrally with a substrate member 130. The device 122 further comprises an emitter element array 132 comprising emitter elements 124 having blunt tips 134 which may be of flat or planar slanted configuration. The device 122 further comprises an array 136 of emitter elements 138,and 142, wherein elements 138 and 142 are oppositely sloped at their tip extremities and are spaced apart from one another, with an intervening tip element 140 having a flat tip surface.

While various embodiments of the field emitter device of the invention have been illustrated as utilizing columnar emitter geometry, which is preferred due to its high design flexibility, other emitter element structures such as simple pyramids or cusps may be utilized in the broad practice of the present invention. The columnar emitter element structure permits the electron emissions to occur at lower voltages in relation to other geometries, due to the ability of the columnar geometry to enhance the electric field at the emitter structure, as well as the ability to selectively contour the electric field associated with the emitter element. The emitter element may have a tip region of a shape as shown in the above-discussed figures hereof, and various column or ribbon structures may be provided with a flat or shaped top (tip) in widely varying manner, in the broad practice of the present invention.

FIGS. 10–14 are a side elevational sectional views of a substrate member illustrating the formation of an array of field emitter elements thereon in the field of one embodiment in the present invention.

Figure 10:
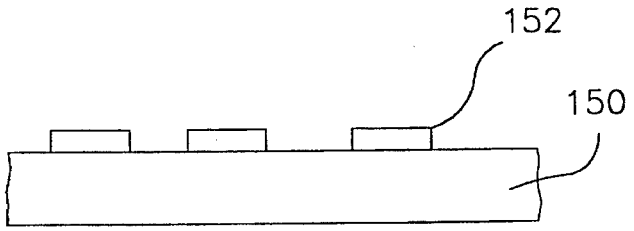
FIGS. 10–14 are side elevational sectional views of a substrate member illustrating the formation of an array of field emitter elements thereon in accordance with one embodiment of the present invention.

Referring to FIG. 10, a wafer base (substrate) member 150 is provided, on which is deposited or grown an etch mask 152. The wafer base may be of silicon or other suitable material, with the etch mask comprising silica ($SiO_2$), $Si_3N_4$, or Al on $SiO_2$. The insulator then is patterned, and subsequently etched, as for example by reactive ion etch (RIE) techniques well known and conventionally used in the art.

Figure 11:
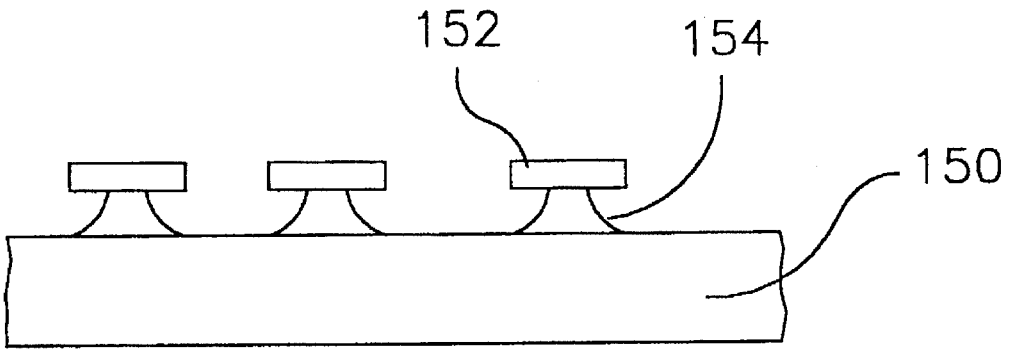

Next, the patterned and etched substrate is isotropically etched, to produce the structure shown in FIG. 11, in which tip portions 154 have been formed on substrate 150. In the case of a silicon substrate, for example, the isotropic etch may be carried out via plasma etching techniques using $SF_6$. The isotropic etch step may be omitted if a flat-top field emitter element geometry is desired.

Figure 12:
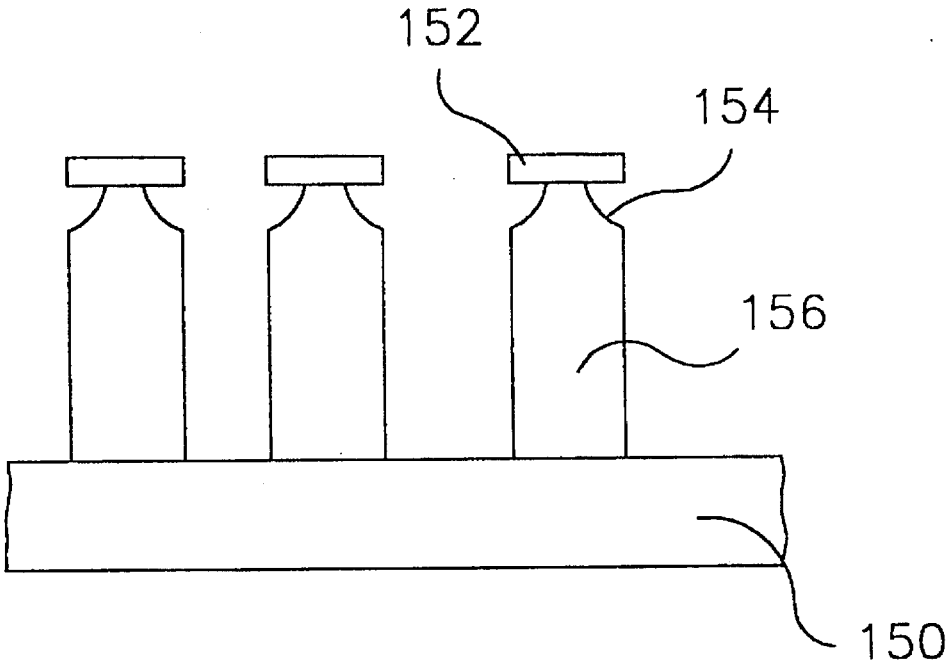

Next, the substrate 150 is etched via RIE technique to yield the structure shown in FIG. 12, in which the substrate 150 has columnar elements 156 formed thereon. In the case of a silicon substrate. The RIE operation producing the structure of FIG. 12 may be carried out utilizing gaseous chlorine in helium.

Next, the tip portion 154 is sharpened and the cap 152 is removed. This may be carried out in any suitable manner using intervention techniques well known and established in the art. As a first methodology, the silicon material may be oxidized and HF or buffered oxide etching may be employed to remove the cap 152. The degree of the oxidation process will determine the sharpness of the resulting emitter element tip, or alternatively if a plateau is left. The oxidized silicon ($SiO_2$) may then be etched in BOE to reveal the tip and remove the cap. If a conduction cap material has been used, the cap may be either removed or alternatively left in place.

As a further alternative methodology for sharpening the emitter element tip and removing the cap therefrom, the silicon may be etched via plasma etching, utilizing $SF_6$ and oxygen) or a wet etching reagent (e.g., HF+acetic acid+nitric acid) may be utilized. Such etching may be repeated as necessary to completion or partial completion, based on the tip shape desired. The cap 152 may, as mentioned, be left in place if it is of a conductive material, however removal of the cap and sharpening of the emitter element tip portion is preferred in most applications. The tip geometry may be varied by modifying the etching characteristics, and process parameters such as pressure, gas composition, and gas flow in the etching (e.g., plasma etch) system, to produce uniform tips, or tips with varied shapes.

Figure 13:
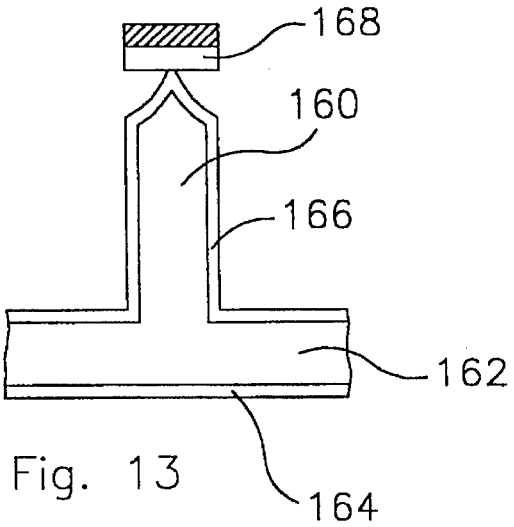
Figure 14:
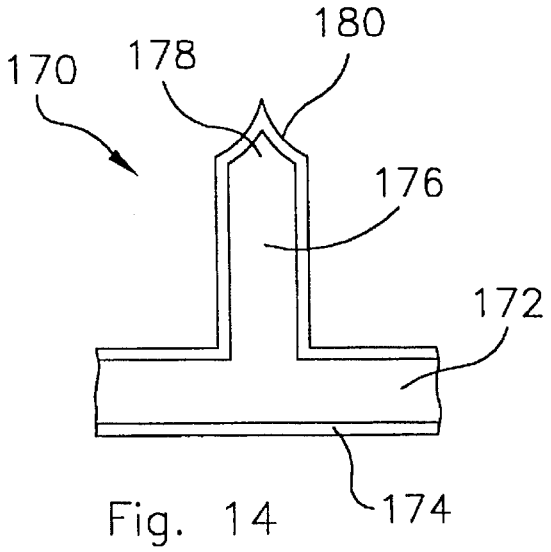

FIGS. 13 and 14 show a field emitter element 160 on a substrate 162, as may be produced by the aforementioned methodology. The emission device shown in FIG. 13 features a backside contact layer 164, e.g., titanium or aluminum, thereon, and the oxidized or etched-away portion 166 is shown, beneath which is the final substrate and emitter element structure. At the upper extremity of the emitter element 160 is provided the cap 168, which may comprise aluminum on silicon nitride.

FIG. 14 shows an emitter device 170 comprising a substrate 172 which may for example be formed of silicon, or tantalum, on the backside of which is provided a contact metal layer 174, of titanium on aluminum. The emitter element 176 features a sharpened tip 178, and the surface of the substrate member 172 and the emitter element 176 is coated with a coating 180 of a low work function material, such as carbon.

Following tip sharpening and removal of the cap, if desired, the field emitter device may be utilized as an electron source (or as an ion source, when contacted with an ionizable species such as a gas of ionizable character), and the device may be suitably utilized in microelectronic devices such as flat panel displays, CRTs, etc.

In some instances, it may be desirable to enhance the performance of the emitter structure, by depositing films of low work function coating material such as ion beam or plasma deposited diamond-like carbon.

Post treatment of the emitter element tips may be carried out in nitrogen and hydrogen forming gas having a composition of 90% hydrogen:10% nitrogen to 10% hydrogen:90% nitrogen, with 6–10% hydrogen and 94–90% nitrogen being preferred for safety reasons.

In addition to diamond-like carbon coating materials, other low work function coatings materials include chromium, chrominum silicide, cesium and barium.

In respect of the emitter element columns in the columnar constructions illustratively described hereinabove, the formation of microporous silicon in the columns may enhance the effect of the above-described post treatments. Microporous silicon may be formed by dipping the field emitter in array hydrogen fluoride, and pulsing the field emitter array while emersed therein, with an electric current.

Once the field emitter array is formed, mounting of the array may be facilitated by patterning and depositing insulator material or high work function material outside of the emitter element regions. Such processing can be utilized to reduce emission from defect sites or edges of the source tip.

Alternatively, the emitter pattern may be designed to leave a large insulator region outside the intended electron emission area, with the low work function footing being on an insulator, and reducing its ability to .couple into an electron source.

Figure 15:
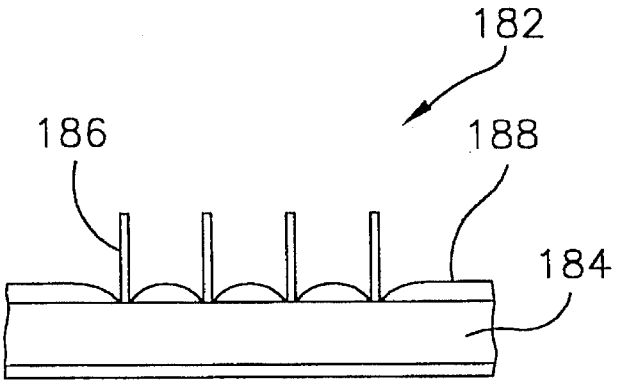
FIG. 15 is a side elevational sectional view of a portion of a field emitter device according to another embodiment of the invention, wherein the field emitter elements are surrounded by a layer of insulator or high work function material.

FIG. 15 shows a field emitter device 182 comprising a substrate 184 having disposed thereon a plurality of field emitter elements 186 constituting a field emission element array, wherein the emitter elements 186 are surrounded by insulator or high work function coating 188, as shown.

In the formation of the field emitter array, an insulator may also be deposited prior to lift-off of the cap at the distal portion of the columnar structure. For example, sputtered alumina may be deposited on the cap prior to etching the silica cap to reveal the tips. The lower etch rate of the alumina causes it to be left, thereby partially insulating the emissive coating from the substrate and providing another variable amenable to selectively controlling the focus and shape of the electron (ion) beam.

In an alternatively process, a resistive layer may be deposited on the substrate, with an optional conductive layer. The substrate may be formed of any suitable physically stable material capable of surviving the processing employed, such as metal, ceramic, or glass.

The emitter column material may be any material capable of being formed to the selected emitter element shape and geometry. In some instances, it may be feasible to form the emitter element by molding or extrusion techniques. As discussed hereinabove, the emitter elements may be formed integrally with the substrate, and such integral character is the preferred structure, however it may be feasible in some instances to fabricate emitter elements which are distinct from the substrate, and which are suitably secured to the substrate member, by suitable bonding or affixation techniques.

The emitter element material of construction may be a material such as tantalum, TiW, silicon, silicides such as $WSi_2$, etc. In the case of silicon, such material may be deposited by any suitable techniques, such as chemical vapor deposition (CVD), evaporation, or sputter techniques. In some instances, it may be advantageous to form columnar field emitter elements of diamond-like carbon, which are employed with a silica ($SiO_2$) cap and RIE-$O_2$ as an etchant.

Figure 16:
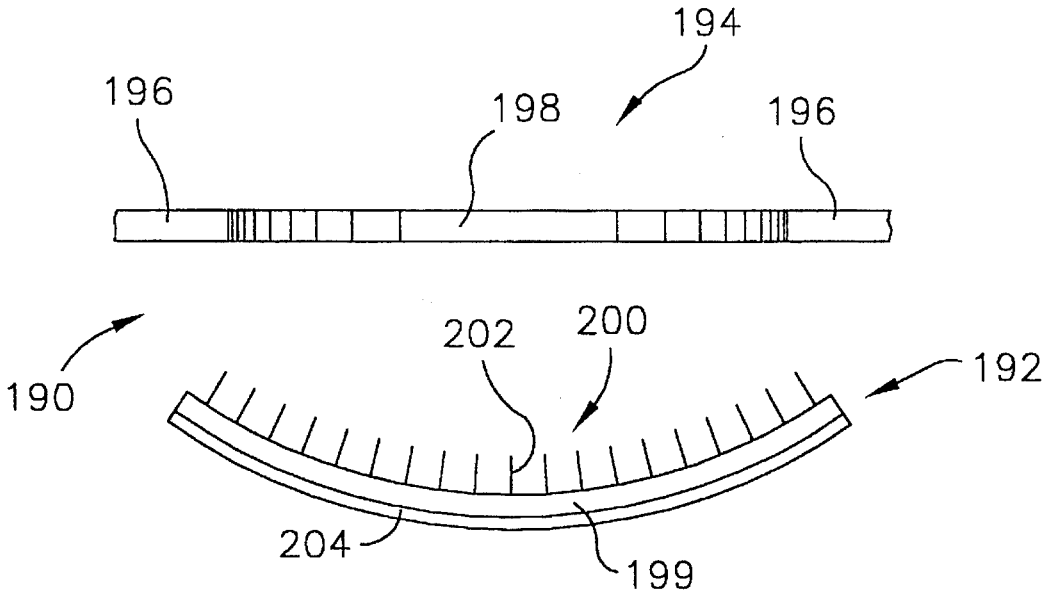
FIG. 16 is a side elevational sectional view of a portion of a field emitter display panel according to one embodiment of the invention, utilizing a curvate field emission panel.

FIG. 16 is a side elevation view of a portion of a field emitter device 190 according to one embodiment of the invention, utilizing a curvate field emission panel 192 in combination with an annode or gate electrode structure 194, wherein in an electrode structure, the gate electrode comprises a circumscribing gate member 196 having an opening 198 circumscribed by the gate structure. In an annode configuration, the portion 198 may be solid and continuous with the portions 196, to provide a continuous annode on which electrons from the curvate cathode are impinged, as focused by the curvate emitter structure. The emitter structure 192 comprises a substrate member 199 having an array 200 of field emitter elements 202 disposed thereon and upwardly extending therefrom to emitter element tips which may be sharpened or otherwise formed in the previously described manner. In this embodiment the substrate member 199 is of a relatively flexible, deformable character, and is associated with a stress-inducing backing layer 204 which are originally secured to the substrate member 199 is of planar character, as is the substrate member 199 itself. The stress-inducing backing layer 204 is processed to impart a differential inwardly deforming translation thereof, to bow or bend the substrate member associated therewith into the curvate (concave) character shown in FIG. 16.

Alternatively, the backing layer 204 may be processed to differentially translate to form an opposite curvature (convex) profile, where by the field emitter elements are correspondingly oriented to provide a desired field flux (intensity) and directionality.

Although the convex curvature of the substrate member 199 in the FIG. 16 embodiment has been described as being imparted by the deformation of backing layer 204, as for example resulting from heating or other differential thermal translation effects which cause the deformation or involution of the substrate member 199, it will be appreciated that the substrate member 199 itself may in some instances be formed of a deformable exertion of selective force on the substrate member on selected portions thereof, without the need of a composite structure including the backing layer 204. Further, although it typically will be necessary to form the emitter elements on a planar substrate member followed by deformation to produce a curvate surface adjacent the emitter elements, it may be feasible in some applications of the invention to form the emitter elements on an initially curvate or otherwise non-planar substrate surface.

For example, it may be feasible in some instances to form the field emitter elements by high speed discharge of molten metal through a nozzle structure to produce needle-like elements in a cooling gas into which the molten metal is discharged, to produce needle-like columnar elements which may then be directionally impacted on a curvate or non-planar substrate to produce a field emitter array thereon.

Figure 17:
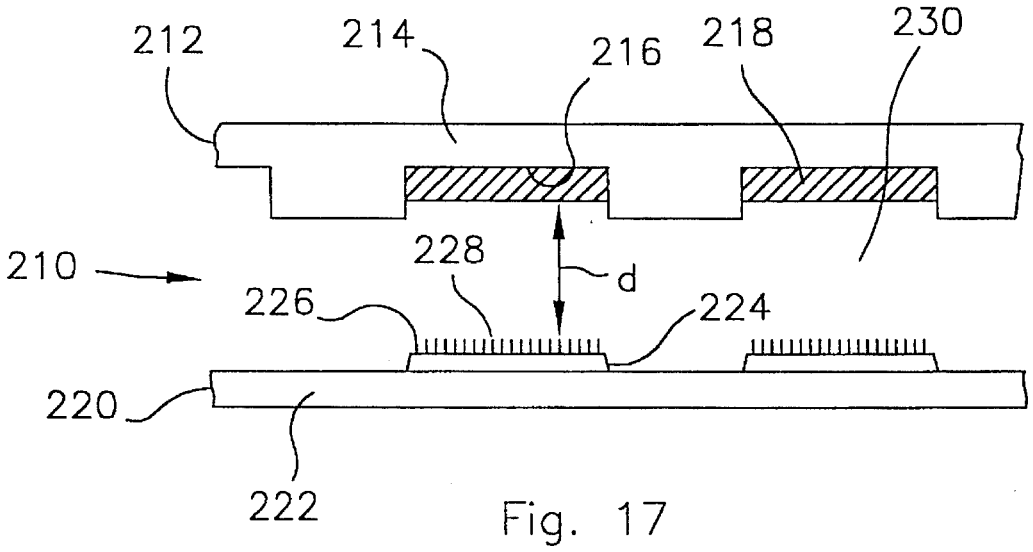
FIG. 17 is a side elevational sectional view of a portion of a field emitter display panel according to another embodiment of the invention.

FIG. 17 is a side elevation section view of a portion of a field emitter display panel 210 according to another embodiment of the invention. The field emitter display panel 210 comprises an upper display structure 212 comprising a second substrate member 214 having cavities 216 therein in which are disposed phosphor elements 218. The field emitter display panel 210 further comprises, in spaced relation to the display structure 212, a lower emitter panel 220 comprising a first substrate member 222 on which is deposited is flattened columnar support element 224 which forms a mesa structure for support of the array 226 of field emitter elements 228 thereon. The upper and lower plate-like members 212 and 220 are spaced apart from one another, so that the phosphor elements 218 and the array 226 of field emitter elements 228 are spaced apart by a distance D as shown in FIG. 17. The plate members 212 and 220 may be fixtured in a circumscribing housing in a known manner, to define an enclosed interior volume 230 between the plate members, which is suitably evacuated to provide a vacuum in the interior volume. The distance D therefore defines a gap in which the electric field may be selectively shaped and focused by the varied conformation structure techniques described hereinabove, so that the electron beam emitted by the array 226 of field emitter elements 228 is focused for high intensity impingement on the phosphor elements 218 to provide a high efficiency display panel structure.

Figure 18:
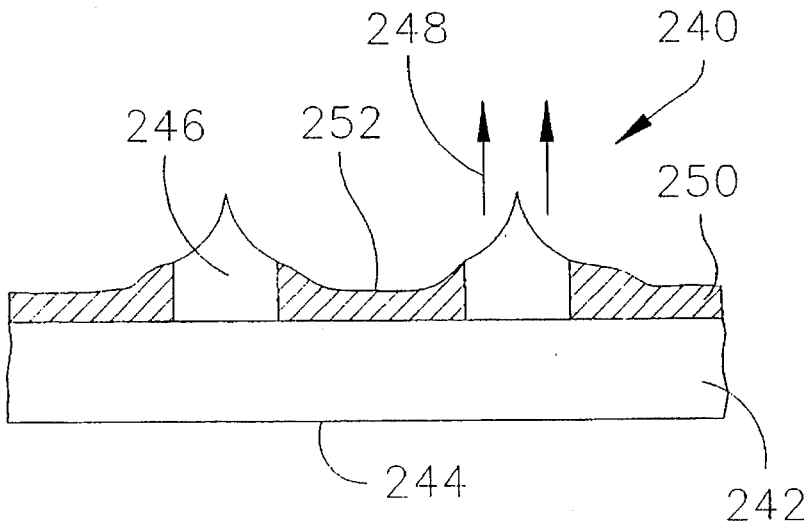
FIG. 18 is a side elevational sectional view of a portion of an ion emitter device according to one embodiment of the invention.

FIG. 18 is a side elevational sectional view of a portion of an ion emitter device 240 according to one embodiment of the present invention, comprising a diffusive substrate 242 through which gas contacting diffusion surface 244 may permeate through the diffusive substrate and the emitter elements 246 to produce ions which are discharged from the emitter elements in an outward direction from the tips of the emitter elements as shown by arrows 248.

The substrate member 242 has a layer 250 thereon of a suitable insulator or metal serving to block ion flow. The layer 250 may for example be formed of aluminum or doped silica. The substrate member 242 may be formed of a material which is diffusively permeable to the gas being contacted with the diffusion surface 244 of the substrate member, such material of construction depending on the gas or fluid species which are being diffusionally translated through the substrate member. For example, in the case of hydrogen diffusion or deuterium diffusion, a suitable diffusive substrate material for the substrate member 242 is palladium or titanium. Thus, the ion source structure 240 may be disposed in contact with a suitable gas and fluid source as diffusion surface 244, with the opposite face of the ion source structure being in contact with a vacuum at such opposite face 252.

The ion source structure 240 may be utilized with a suitable gate electrode or conductive grid (not shown) serving to correct and further focus the stream of ions discharged from the field emitter elements 246 of the ion source structure.

It will be understood in connection with the foregoing illustrative embodiments of the invention that the field emitter elements in the various embodiments of the invention may be provided with input voltage thereto in a conventional manner well-known and established in the art.

Figure 19:
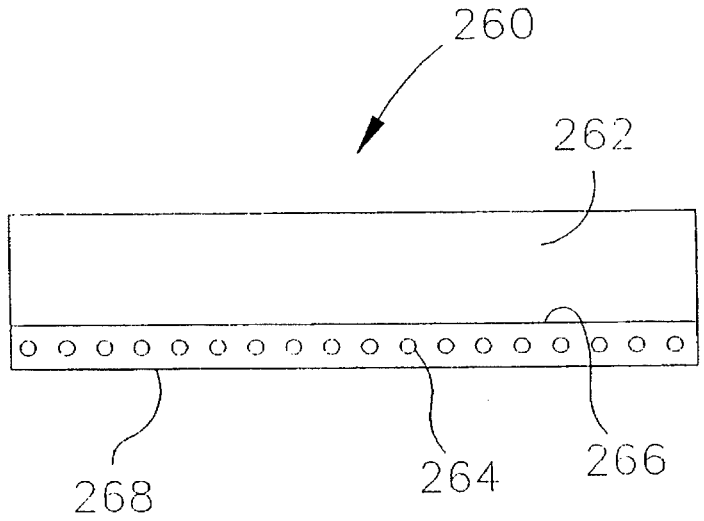
FIG. 19 is a side elevation view of a portion of a phosphor array device according to one embodiment of the invention.

FIG. 19 is a side elevation sectional view of a portion of a phosphor array device 260 according to the present invention. The phosphor array device 260 comprises a substrate member 262 which may be formed of any suitable material, such as glass, ceramic, or polymeric material, on one surface of which is disposed an array of phosphor elements 264 which may for example comprise phosphor particles of suitable particle size distribution.

The phosphor element array may be disposed on the substrate surface 266 via any appropriate deposition technique, such as deposition from a suspension containing such particles, or mechanical deployment and affixation to the substrate member 262.

Overcoated on the array of phosphor particles 264 is a diamond-like film 268 which serves to (1) maintain the phosphor elements in position, (2) provide enhanced thermal conductivity for faciliting heat dissipation in operation of the display unit, when the phosphor elements are impinged with electron beams, and (3) provide sufficient electrical conductivity to transfer charge away from the illuminated area away from the display unit.

The use of a diamon-like film thus overcomes the prior art problems associated with phosphor particle migration and heat dissipation.

The diamond-like film may be deposited over the phosphor elements in any suitable manner, such as for example by plasma deposition, high energy evaporation, ion beam deposition, etc. Films of diamond-like carbon are usefully employed since they have low electron absorption cross section, which in turn enables minimal energy loss in the display unit, while such diamond-like carbon film provides many of the benefits of conventional materials such as aluminum which are utilized for phosphor-containing screens. While the diamond-like film does not provide as high a light reflectivity as conventionally used aluminum coatings, diamond-like films can provide a black matrix effect for improvement of constrast when the film is doped with a suitable dopant species at appropriate concentration. Preferred dopant species for such purpose include nitrogen and boron, both of which provide considerable diamond-like film darkening. The doping of the diamond-like film may be readily effected via conventional techniques. Nitrogen doping for example may be effected via $NF_3$ addition during deposition of the diamond-like film material.

The diamond-like carbonaceous film may be deposited directly onto phosphor particles, thin film phosphors, or removable sacrificial material layers coated over a phosphor particle layer. When a sacrificial material layer, e.g., a nitrocellulose sacrificial layer, is employed over a microparticle phosphor layer, a contiguous film is produced with high electrical sheet conductivity. The sacrificial layer may be removed either chemically or physically, such as by heating, in the case of a sacrificial material layer such as a spun-on nitrocelluose film. Upon heating of the nitrocellulose film to temperatures on the order of about 400° C., the nitrocellulose self-oxidizes, resulting in a smoothing of the substrate on which the phosphor element is disposed. The display unit of the invention thus provides superior stability and thermal conductivity characteristics, as well as contrast enhancement when the film is doped with suitable dopant species.

Further, if the diamond-like carbon films are formed over the phosphor element array on the substrate, and the carbonaceous film is not exposed to significant amounts of air or moisture subsequent to film deposition prior to assembly of the display unit in a device incorporating an electron source, then the carbonaceous film may also provide sorptive capability which in turn provides a vacuum getter effect in the device comprising the electron source and the phosphor display plate, to effect sorptive removal of contaminant gases in the interior volume of the overall device. Such vacuum gettering effect may be further enhanced by bakeout of the carbonaceous film material prior to final pumpdown and sealing of the overall device such as a flat panel display apparatus.

While the invention has been described herein with respect to various illustrative aspects, features and embodiments, it will be appreciated that numerous variations, modifications and other embodiments are possible, and all such alternative variations, modifications and other embodiments are therefore to be regarded as being within the spirit and scope of the present invention.

What is claimed is:

1. A field emitter device for the selective emission of an electron and/or ion beam when turn-on voltage is applied thereto, comprising a substrate member having an array of field emitter elements thereon, wherein at least one of the field emitter elements and substrate member has a varied conformation producing a beam with at least one characteristic of higher intensity and different directional character than a corresponding field emitter device wherein the field emitter elements and substrate member has a uniform conformation, and wherein the varied conformation comprises at least one structural feature selected from the group consisting of:

(i) a varying density of emitter elements on the substrate member;

(ii) an electrical resistance-varying composition of the field emitter elements, which is variable among the field emitter elements of the array, or sub-array portions thereof;

(iii) an electrical resistance-varying composition of the substrate member or portions thereof;

(iv) an electrical resistance-varying material interposed between the substrate member and at least some of the field emitter elements of the array;

(v) varying height amount the field emitter elements of the array, wherein the array comprises vertically upwardly extending columnar field emitter elements; and (vi) a non-planar shape of the substrate member over at least a portion of its surface area having the field emitter elements disposed thereon.

2. A field emitter device according to claim 1, comprising means for inputting a substantially uniform turn-on voltage to the field emitter elements in the array.

3. A field emitter device according to claim 1, which is constructed and arranged to produce an electron beam output.

4. A field emitter device according to claim 1, which is constructed and arranged to produce an ion beam output.

5. A field emitter device according to claim 1, wherein said field emitter device comprises a functional apparatus selected from the group consisting of flat panel displays, cathode ray tubes, klystrons, cross field amplifiers, triodes, pentodes, electron beam microscopes, and E-beam writing tools.

6. A field emitter device according to claim 1, wherein the field emitter elements comprise ungated columnar emitter elements.

7. A field emitter device according to claim 1, wherein a low work function material is coated on the field emitter elements of the array.

8. A field emitter device according to claim 1, wherein an insulator or high work function material is coated on the substrate member surrounding the field emitter elements disposed on the substrate member.

9. A field emitter device according to claim 1, further comprising an anode structure comprising a second substrate member in spaced relationship to the field emitter elements, and in electron or ion-receiving relationship therewith, having disposed on the second substrate member an array of phosphor elements, with a diamond-like film deposited on the phosphor elements.

10. A field emitter device according to claim 9, wherein the diamond-like film is doped with a dopant species to darken the diamond-like film and enhance the contrast character of the display article.

11. A field emitter device according to claim 10, wherein the dopant species is selected from the group consisting of nitrogen, fluorine and boron.

12. A field emitter device according to claim 9, wherein the diamond-like film comprises a carbonaceous material of sorptive affinity for non-inert atmospheric gases.

13. A display article, for producing an output in response to impingement of electron beams thereon, said beams being produced by electron emitting means, and said beams being focused by focusing means, comprising a substrate member on which is disposed an array of phosphor elements, with a diamond-like film coated on the phosphor elements to maintain the phosphor elements in position on the substrate member.

14. A display article according to claim 13, wherein the phosphor elements on the substrate has been overcoated with a sacrificial material layer, followed by coating of the diamond-like film thereon, followed by removal of the sacrificial layer.

15. A display article according to claim 13, wherein the sacrificial material layer comprises nitrocellulose, and said removal comprises heating thereof.

16. A display article according to claim 13, wherein the diamond-like film is doped with a dopant species to darken the diamond-like film and enhance the contrast character of the display article.

17. A display article according to claim 16, wherein the dopant species is selected from the group consisting of boron and nitrogen.

18. A display article according to claim 13, wherein the diamond-like film comprises a carbonaceous material of sorptive affinity for non-inert atmospheric gases.

19. A field emission flat panel display, including:

an electron beam source means comprising a substrate member, an array of field emitter elements disposed thereon, and at least one gate electrode for said array, wherein at least one of the field emitter elements and the substrate member have a varied conformation producing a beam having at least one of the enhanced characteristics selected from the group consisting of higher intensity and a different directional character as compared with a field emitter device having uniformly conformed field emitter elements and substrate members; and an anode structure comprising a second substrate member in spaced relationship to the field emitter elements, and in charged particle-receiving relationship therewith, having disposed on the second substrate member an array of phosphor elements, with a diamond-like film deposited on the phosphor elements.

* * * * *